US006206939B1

(12) United States Patent
Botros

(10) Patent No.: US 6,206,939 B1
(45) **Date of Patent: *Mar. 27, 2001**

(54) WAX ANTI-SETTLING AGENTS FOR DISTILLATE FUELS

(75) Inventor: Maged G. Botros, West Chester, OH (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/311,465

(22) Filed: May 13, 1999

(51) Int. Cl.[7] ..... C10L 1/18; C10L 1/22

(52) U.S. Cl. ..... 44/347

(58) Field of Search ..... 44/347, 351, 331

(56) References Cited

U.S. PATENT DOCUMENTS

| | | | | |
|---|---|---|---|---|
| 2,620,308 | | 12/1952 | Steward | 252/52 |
| 2,965,678 | | 12/1960 | Sunberg et al. | 260/615 |
| 2,977,344 | | 3/1961 | Zopf et al. | 260/27 |
| 3,048,479 | | 8/1962 | Ilnyckyj et al. | 44/62 |
| 3,250,599 | | 5/1966 | Kirk et al. | 44/62 |
| 3,382,056 | * | 5/1968 | Mehmedbasich | 44/351 |
| 3,444,082 | | 5/1969 | Kautsky | 252/51.5 |
| 3,462,249 | | 8/1969 | Tunkel | 44/62 |
| 3,471,458 | | 10/1969 | Mehmedbasich | 260/78.5 |
| 3,560,456 | | 2/1971 | Hazen et al. | 260/78.5 |
| 3,620,696 | | 11/1971 | Hollyday et al. | 44/62 |
| 3,694,176 | | 9/1972 | Miller | 44/62 |
| 3,854,893 | | 12/1974 | Rossi | 44/62 |
| 3,966,428 | | 6/1976 | Rossi | 44/62 |
| 4,151,069 | | 4/1979 | Rossi | 208/33 |
| 4,178,950 | | 12/1979 | Sweeney | 137/13 |
| 4,178,951 | | 12/1979 | Sweeney | 137/13 |
| 4,240,916 | | 12/1980 | Rossi | 252/56 |
| 4,402,845 | | 9/1983 | Zoleski et al. | 252/52 |
| 4,746,327 | | 5/1988 | Smyser | 44/62 |
| 4,862,908 | | 9/1989 | Payer | 137/13 |
| 4,863,486 | | 9/1989 | Tack et al. | 44/62 |
| 4,882,034 | | 11/1989 | Tack et al. | 208/15 |
| 4,900,332 | | 2/1990 | Denis et al. | 44/62 |
| 4,919,685 | * | 4/1990 | Herbstman et al. | 44/347 |
| 4,985,048 | | 1/1991 | Wirtz et al. | 44/394 |
| 5,011,505 | | 4/1991 | Lewtas et al. | 44/393 |
| 5,189,231 | | 2/1993 | Canova et al. | 585/4 |
| 5,256,166 | | 10/1993 | Fischer et al. | 44/393 |
| 5,525,128 | | 6/1996 | McAleer et al. | 44/459 |
| 5,588,973 | * | 12/1996 | Blackborow et al. | 44/347 |
| 5,681,359 | | 10/1997 | Botros | 44/393 |

FOREIGN PATENT DOCUMENTS

| | | | |
|---|---|---|---|
| 1940944 | | 5/1970 | (DE) . |
| 0 254 284 A1 | | 1/1988 | (DE) . |
| 0 030 099 A1 | | 6/1981 | (EP) . |
| 0196217 A2 | | 1/1986 | (EP) . |
| 0 654 526 A2 | | 5/1995 | (EP) . |
| 1245879 | | 8/1971 | (GB) . |
| 1374051 | | 11/1974 | (GB) . |
| 1 593 672 | | 7/1981 | (GB) . |
| 54-157106 | * | 12/1979 | (JP) . |
| 046096 | | 11/1981 | (JP) . |
| 072942 | | 12/1981 | (JP) . |
| 117188 | | 12/1986 | (JP) . |
| 249860 | | 5/1987 | (JP) . |

OTHER PUBLICATIONS

Hihara et al., *91:213717e Fuel Oil Compositions*, Chemical Abstracts, vol. 91, 1979.

Hihara et al., *91:195808d Fuel Oil Compositions*, Chemical Abstracts, vol. 91, 1979.

Nishikawa, et al., *92:200767s Fuel Oil Compositions*, Chemical Abstracts, vol. 92, 1979.

* cited by examiner

*Primary Examiner*—Margaret Medley
*Assistant Examiner*—Cephia D. Toomer
(74) *Attorney, Agent, or Firm*—Shao Guo

(57) ABSTRACT

An additive for distillate fuels and a fuel composition having improved wax anti-settling properties. The additive is incorporated into a major proportion of distillate fuel and is a maleic anhydride α-olefin copolymer or a imide having the following structure

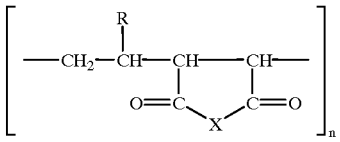

wherein R has at least 60% by weight of a hydrocarbon substituent from about 20 to about 40 carbon atoms, X is oxygen or

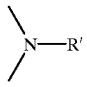

wherein N is nitrogen and R' has at least 80% by weight of a hydrocarbon substituent having from 16 to 18 carbon atoms, and n is from about 2 to about 8 for the maleic anhydride α-olefin copolymer and from about 1 to about 8 for the imide. The additive can be combined with an ethylene vinyl acetate copolymer, ethylene vinyl acetate isobutylene terpolymer, or combinations thereof, to improve cold flow of the distillate fuel.

8 Claims, No Drawings

WAX ANTI-SETTLING AGENTS FOR DISTILLATE FUELS

FIELD OF THE INVENTION

This invention relates to improved fuel additives which are useful as wax anti-settling agents and fuel compositions incorporating these additives.

BACKGROUND OF THE INVENTION

Distillate fuels such as diesel fuels tend to exhibit reduced flow at reduced temperatures due in part to formation of solids in the fuel. The solids, which are wax crystals, have a slightly higher density than the distillate fuels at a given temperature, and as a result there is a tendency for the wax to settle to the bottom of the storage container. The reduced flow of the distillate fuel affects the transport and use of the distillate fuels not only in the refinery but also in an internal combustion engine. If the distillate fuel is cooled to below a temperature at which solid formation begins to occur in the fuel, generally known as the cloud point (ASTM D 2500) or wax appearance point (ASTM D 3117), solids forming in the fuel in time will essentially prevent the flow of the fuel, plugging piping in the refinery, during transport of the fuel, and in inlet lines supplying an engine. Under low temperature conditions during consumption of the distillate fuel, as in a diesel engine, wax precipitation and gelation can cause the engine fuel filter to plug. Wax formation and settling can occur in the fuel tank after an extended period of non-use, such as overnight, and increase the chances of engine failure because of nonuniform wax enrichment. The same problem of wax settling can occur on a larger scale in fuel storage tanks. Under conditions where the fuel still flows after solids have formed in the fuel, an effect known as channeling may occur. When the outlet valve on the container is opened, the initial fuel flow will be wax enriched. Then, a channel is created in the wax layer, allowing a quantity of liquid fuel depleted in wax to flow. The low-wax fuel will continue to flow if the container is not refilled or agitated. The final portion of fuel flowing from the container will then be highly wax enriched.

As used herein, distillate fuels encompass a range of fuel types, typically including but not limited to kerosene, intermediate distillates, lower volatility distillate gas oils, and higher viscosity distillates. Grades encompassed by the term include Grades No. 1-D, 2-D and 4-D for diesel fuels as defined in ASTM D 975, incorporated herein by reference. The distillate fuels are useful in a range of applications, including use in automotive diesel engines and in non-automotive applications under both varying and relatively constant speed and load conditions.

The wax settling behavior of a distillate fuel such as diesel fuel is a function of its composition. The fuel is comprised of a mixture of hydrocarbons including normal paraffins, branched paraffins, olefins, aromatics and other non-polar and polar compounds. As the diesel fuel temperature decreases at the refinery, during transport, storage, or in a vehicle, one or more components of the fuel will tend to separate, or precipitate, as a wax.

The components of the diesel fuel having the lowest solubility tend to be the first to separate as solids from the fuel with decreasing temperature. Straight chain hydrocarbons, such as normal paraffins, typically have the lowest solubility in the diesel fuel. Generally, the paraffin crystals which separate from the diesel fuel appear as individual crystals. As more crystals form in the fuel, they tend to agglomerate and eventually reach a particle size which is too great to remain suspended in the fuel.

It is known to incorporate additives into diesel fuel to enhance the flow properties of the fuel at low temperatures. These additives are generally viewed as operating under either or both of two primary mechanisms. In the first, the additive molecules have a configuration which allows them to interact with the n-paraffin molecules at the growing ends of the paraffin crystals. The interacting additive molecules by steric effects act as a cap to prevent additional paraffin molecules from adding to the crystal, thereby limiting the dimensions of the existing crystal. The ability of the additive to limit the dimensions of the growing paraffin crystal is evaluated by low temperature optical microscopy or by the pour point depression (PPD) test, ASTM D 97, incorporated herein by reference.

In the second mechanism, the flow modifying additive may improve the flow properties of diesel fuel at low temperatures by functioning as a nucleator to promote the growth of smaller size crystals. This modified crystal shape enhances the flow of fuel through a filter, and the ability of the additive to improve flow by altering the n-paraffin crystallization behavior is normally evaluated by tests such as the Cold Filter Plugging Point (CFPP) Test, IP 309, incorporated herein by reference.

Additional, secondary, mechanisms involving the modification of wax properties in the fuel by incorporation of additives include, but are not limited to, dispersal of the wax in the fuel and solubilization of the wax in the fuel.

A number of additives may be incorporated into distillate fuels for various reasons to adjust various characteristics of the fuel, such as cloud point, pour point or cold filter plugging point. However, additives introduced to improve these characteristics may have an antagonistic effect on the wax anti-settling properties of the fuel. For example, incorporating a flow improving additive having a higher density constituent, such as vinyl acetate, will improve the flow characteristics of the fuel but will also increase the density of any wax crystals containing the additive. As will be discussed below, increasing the density of the wax crystal relative to the liquid fuel tends to undesirably accelerate the settling rate of the wax.

The wax crystals forming in a fuel normally have a slightly higher density than the liquid fuel portion. Consequently, when the fuel in a storage container cools to temperatures below the cloud point, crystals will form and will tend to settle to the bottom of the container. The rate of wax settling is dependent on the properties of the liquid fuel, primarily the density and viscosity, and the size and shape of the wax crystals. Stokes Law quantitatively describes the relationship, wherein the settling rate is a function of the solid crystal diameter, solid crystal density, liquid density and the fuel viscosity at a particular temperature, according to the following equation $$R = \left[(D)^2\left(\frac{1}{18}\right)\left(\frac{d_c}{d_L}\right)G\right] \div V$$

where $R$ = settling rate (cm/sec)
$D$ = diameter of crystal (cm)
$d_c$ = crystal density (g/cm$^3$)
$d_L$ = liquid density (g/cm$^3$)
$G$ = gravitational constant = 981 cm/sec$^2$
$V$ = fuel viscosity (poise)

At a temperature of −10° C. where the difference in density between crystal and liquid is about 0.1 g/cm$^3$ and the fuel viscosity is 10 cSt (0.08 poise), reducing the crystal particle size from 100 microns to 10 microns will reduce the settling rate from 0.25 meter/hr to 0.06 meter/day under static conditions.

The range of available diesel fuels includes Grade No. 2-D, defined in ASTM D 975-90 (incorporated herein by reference) as a general purpose, middle distillate fuel for automotive diesel engines, which is also suitable for use in non-automotive applications, especially in conditions of frequently varying speed and load. Certain of these Grade No. 2-D (No. 2) fuels may be classified as being hard to treat when using one or more additives to improve flow. A hard-to-treat diesel fuel is either unresponsive to a flow improving additive, or requires increased levels of one or more additives relative to a normal fuel to effect flow improvement.

Fuels in general, and diesel fuels in particular, are mixtures of hydrocarbons of different chemical types (i.e., paraffins, aromatics, olefins, etc.) wherein each type may be present in a range of molecular weights and carbon lengths. The tendency of suspended solid waxes to settle is a function of one or more properties of the fuel, the properties being attributed to the composition of the fuel. For example, in the case of a hard-to-treat fuel the compositional properties which render a fuel hard to treat relative to normal fuels include a narrower wax distribution; the virtual absence of very high molecular weight waxes, or inordinately large amounts of very high molecular weight waxes; a higher total percentage of wax; and a higher average normal paraffin carbon number range. It is difficult to generate a single set of quantitative parameters which define a hard-to-treat fuel. Nevertheless, measured parameters which tend to identify a hard-to-treat middle distillate fuel include a temperature range of less than 100° C. between the 20% distilled and 90% distilled temperatures (as determined by test method ASTM D 86 incorporated herein by reference), a temperature range less than 25° C. between the 90% distilled temperature and the final boiling point (see ASTM D 86), and a final boiling point above or below the temperature range 360° to 380 C.

Hard-to-treat fuels are particularly susceptible to wax settling phenomena due to the composition of the fuel. In a hard-to-treat fuel a large quantity of wax tends to settle at a faster rate. Fuel enhanced in long chain wax components tend to exhibit faster separation of wax crystals. Also, fuels with a narrow wax distribution tend to exhibit more sudden precipitation of wax crystals.

The phenomenon of wax settling out of a fuel manifests itself in static environments, such as during bulk storage or in a fuel tank. Where sufficient wax separates from and settles out of the fuel mixture, engine flow is effectively impeded or even interrupted completely. There continues to be a demand for additives which improve the wax anti-settling characteristics of distillate fuels. Further, there remains a need for additive compositions which are capable of improving the wax anti-settling properties of hard-to-treat fuels.

SUMMARY OF THE INVENTION

It has been found that certain polyimide and maleic anhydride olefin copolymer additives with at least a minimum concentration by weight of substituents on the additives having a specified range of carbon chain lengths will improve the wax anti-settling properties of certain distillate fuels such as No. 2 diesel fuel. In addition, the above additives in combination with other materials such as ethylene vinyl acetate copolymers or ethylene vinyl acetate isobutylene terpolymers demonstrate substantial improvement in the wax anti-settling properties of certain distillate fuels while also improving their cold flow characteristics such as pour point and cold filter plugging point when the additive combination is incorporated therein. The use of a flow improving additive in combination with the wax anti-settling additive enhances the operability of the treated fuel.

Copending application Ser. No. 09/311,459 filed on the same date herewith is directed to the combination of an ethylene vinyl acetate isobutylene terpolymer with one or more additive components including certain maleic anhydride α-olefin copolymer and imide components to effect cold flow improvement in distillate fuels.

The maleic anhydride olefin copolymer additive is prepared by the reaction of maleic anhydride with α-olefin. Generally this copolymer additive contains substantially equimolar amounts of maleic anhydride and α-olefin. The operative starting α-olefin is a mixture of individual α-olefins having a range of carbon numbers. The starting α-olefin composition used to prepare the maleic anhydride olefin copolymer additive of the invention has at least a minimum α-olefin concentration by weight with a carbon number within the range from about $C_{20}$ to about $C_{40}$. The additive generally contains blends of α-olefins having carbon numbers within this range. The operative starting α-olefin may have a minor component portion which is outside the above carbon number range. The maleic anhydride α-olefin copolymers have a number average molecular weight in the range of about 1,000 to about 5,000 as measured by vapor pressure osmometry.

The invention also encompasses a wax anti-settling additive comprising an imide produced by the reaction of an alkyl amine, maleic anhydride and α-olefin. Generally the imide is produced from substantially equimolar amounts of maleic anhydride and α-olefin. The operative α-olefin is similar in composition to that described above for the maleic anhydride olefin copolymer additive. Particularly advantageous wax anti-settling properties are obtained when the alkyl amine is tallow amine. The imide has a number average molecular weight in the range of about 1,000 to about 8,000 as measured by vapor pressure osmometry.

DETAILED DESCRIPTION OF THE INVENTION

It has been found that unexpectedly advantageous wax anti-settling properties can be imparted to distillate fuels by incorporating an additive having the following structure:

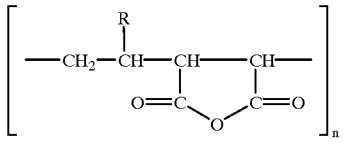

wherein R has at least 60% by weight of a hydrocarbon substituent from about 20 to about 40 carbons, and n is from about 2 to about 8. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. The resulting maleic anhydride α-olefin copolymer has a number average molecular weight in the range of about 1,000 to about 5,000, as determined by vapor pressure osmometry.

The wax anti-settling additive of this invention typically encompasses a mixture of hydrocarbon substituents of varying carbon number within the recited range, and encompasses straight and branched chain moieties.

It has also been found that an additive of the structure

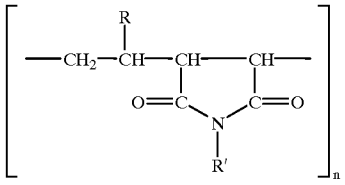

wherein R has at least 60% by weight of a hydrocarbon substituent from about 20 to about 40 carbons, R' has at least 80% by weight of a hydrocarbon substituent from 16 to 18 carbons, and n is from about 1 to about 8, also has wax anti-settling properties. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. Typically, R' has at least 90 % by weight of a hydrocarbon substituent from 16 to 18 carbons. The above additive, described as an imide, has a number average molecular weight as determined by vapor pressure osmometry in the range of about 1,000 to about 8,000.

The phenomenon of wax settling occurs in static systems, such as storage tanks, shipping tanks or even fuel tanks where no separate agitation is supplied. To replicate the static conditions which promote wax settling and permit evaluation of additives, the following test has been devised and used in evaluating wax anti-settling activity.

The fuel composition to be evaluated is poured into a 10.0 ml graduated test tube, marked with subdivisions down to 0.1 ml. The tube is filled to the 10.0 ml mark with the fuel composition and placed into a constant temperature bath set at −20° C. The tube containing the fuel is then visually monitored without disturbing the contents over a period of days. As the fuel composition initially cools, wax will solidify from the solution but remain suspended in the fuel. The fuel after initial cooling will have a uniform opaque appearance. With continued storage at the test temperature, the wax begins to settle. The test tube contents begin to clear at the top, with increasing amounts of the wax settling to the bottom. The additive's effectiveness is measured by its ability to keep the suspended wax dispersed throughout the volume of the fuel stored in the graduated test tube so that the test tube contents remain as uniformly opaque as possible. Initially all the fuel samples will have 100% suspended wax. The purpose of the additive is to maintain a uniform opaque appearance of the fuel, i.e., to minimize the change in suspended wax percentage. The test records the amount of suspended wax remaining in the test tube after a specified time.

Optionally, the maleic anhydride α-olefin copolymer or imide can be combined with an ethylene vinyl acetate copolymer or an ethylene vinyl acetate isobutylene terpolymer, or combinations thereof, to produce an additive combination which has both wax anti-settling properties and cold flow improving properties, wherein the tendency of the cold flow improver to accelerate settling of suspended wax is substantially eliminated or at least counterbalanced by the wax anti-settling additive. This combination of wax anti-settling additive of the invention with cold flow improving additive provides beneficial operability enhancement characteristics in fuels relative to those incorporating cold flow improving additives alone. Useful cold flow improving ethylene vinyl acetate copolymers and ethylene vinyl acetate isobutylene terpolymers have a weight average molecular weight in the range of about 1,500 to about 18,000, a number average molecular weight in the range of about 400 to about 3,000, and a ratio of weight average molecular weight to number average molecular weight from about 1.5 to about 6. Preferably the weight average molecular weight ranges from about 3,000 to about 12,000, and the number average molecular weight ranges from about 1,500 to about 2,500. Both the copolymers and terpolymers have a Brookfield viscosity in the range of about 100 to about 300 centipoise at 140° C. Typically the Brookfield viscosity is in the range of about 100 to about 200 centipoise. Vinyl acetate content is from about 25 to about 55 weight percent. Preferably the vinyl acetate content ranges from about 30 to about 45 weight percent. The branching index is from 2 to 15, and preferably 5 to 10. For the terpolymers, the rate of isobutylene introduction depends on the rate of vinyl acetate introduction, and may range from about 0.01 to about 10 times the rate of vinyl acetate monomer flow rate to the reactor. Useful amounts of the copolymers, terpolymers, or mixtures thereof range from about 50 to about 1,000 ppm by weight of the fuel being treated. Preferred amounts of copolymers, terpolymers, or mixtures thereof to provide cold flow improving properties range from about 50 to about 500 ppm by weight of treated fuel. The use of the maleic anhydride α-olefin copolymer or imide wax anti-settling additives in combination with at least one distinct fuel additive for improving separate flow characteristics of the fuel confers an operability enhancement to the fuel beyond what would be obtained without the wax anti-settling additive as shown in more detail below.

The maleic anhydride α-olefin copolymer or imide additives of the present invention act as wax anti-settling agents when effective amounts are added to distillate fuels. Useful amounts of the additives range from about 25 to about 1,000 ppm by weight of the fuel being treated. Generally, higher amounts of additives tend to exert a greater wax anti-settling effect. However, the higher additive levels also introduce a larger quantity of non-fuel material into the distillate fuel. It is desired that additive concentrations be sufficient to effect a demonstrable improvement in wax anti-settling performance without adding a substantial amount of non-fuel material to the distillate fuel. Preferred amounts of the additives to improve wax anti-settling properties range from about 50 to about 250 ppm by weight of treated fuel. Maleic anhydride α-olefin copolymers and imides used according to the teachings of this invention may be derived from α-olefin products such as those manufactured by Chevron Corporation and identified as Gulftene® 24–28 and 30+ Alpha-Olefins.

The wax anti-settling additives of this invention may be used as the sole additive, may be used in combination with one or more copolymers or terpolymers as described above to provide operability enhancement, or may be used in combination with other fuel additives such as corrosion inhibitors, antioxidants, sludge inhibitors, cloud point depressants, and the like.

OPERATING EXAMPLES

The following detailed operating examples illustrate the practice of the invention in its most preferred form, thereby enabling a person of ordinary skill in the art to practice the invention. The principles of this invention, its operating parameters and other obvious modifications thereof, will be understood in view of the following detailed procedure.

In evaluating wax anti-settling performance or other flow improving property, the additives described below were combined with a variety of diesel fuels at a weight concentration of 100–1,000 ppm additive in the fuel. In all evaluations herein the additive or additive package was combined with the fuel from a concentrate. One part of a 1:1 weight mixture of additive and xylene was combined with 19 parts by weight of the fuel to be evaluated to prepare the concentrate. The actual final weight concentration of additive in the fuel was adjusted by varying the appropriate amount of the concentrate added to the fuel. If more than one additive was incorporated into the fuel, individual additive concentrates were mixed into the fuel substantially at the same time.

It has been found that the effectiveness of the maleic anhydride α-olefin copolymer and imide compositions as wax anti-settling additives is related to the structure of the additive. The α-olefin used in making the above compositions is a mixture of individual α-olefins having a range of carbon numbers. The starting α-olefin used to prepare the maleic anhydride olefin copolymer additive and the imide additive of the invention has at least a minimum concentration by weight which has a carbon number within the range from about $C_{20}$ to about $C_{40}$, and preferably in the range of $C_{24}$ to $C_{40}$. The substituent "R" in the above formulas will have carbon numbers which are two carbons less than the α-olefin length, two of the α-olefin carbons becoming part of the polymer chain directly bonded to the repeating maleic anhydride or imide rings. Generally, α-olefins are not manufactured to a single carbon chain length, and thus the manufactured product will consist of component portions of individual α-olefins of varying carbon chain length. In addition, the substituent "R'" used in the imide wax anti-settling additives will also have a minimum concentration within a range of carbon numbers.

Tallow amine is useful to introduce the R' substituent in connection with imide manufacture, and is generally derived from tallow fatty acid. Thus, the range and percentage of carbon numbers for the components of the tallow amine will generally be those of tallow fatty acid. Tallow fatty acid is generally derived from beef tallow or mutton tallow. Though the constituent fatty acids may vary substantially in individual concentration in the beef tallow or mutton tallow based on factors such as source of the tallow, treatment and age of the tallow, general values have been generated and are provided in the table below. The values are typical rather than average.

TALLOW COMPOSITION TABLE

| | Constituent Fatty Acids (g/100 g Total Fatty Acids) | | | | |
|---|---|---|---|---|---|
| | Saturated | | | Unsaturated | |
| Fat | Myristic ($C_{14}$) | Palmitic ($C_{16}$) | Stearic ($C_{18}$) | Oleic ($C_{18:1}$) | Linoleic ($C_{18:2}$) |
| Beef Tallow | 6.3 | 27.4 | 14.1 | 49.6 | 2.5 |
| Mutton Tallow | 4.6 | 24.6 | 30.5 | 36.0 | 4.3 |

Source: CRC Handbook of Chemistry and Physics, 74th ed. (1993–1994); p. 7–29.

The fatty acids from beef or mutton tallow can also be hydrogenated to lower the degree of unsaturation. Thus a tallow amine may contain a major portion by weight of unsaturated amine molecules, and alternatively with sufficient hydrogenation treatment may contain virtually no unsaturated amine molecules. Even with variations in tallow amine composition referred to above it is expected that the concentration by weight of hydrocarbon substituents from 16 to 18 carbons will be at least 80% by weight, and typically at least 90% by weight.

The following table lists several maleic anhydride α-olefin copolymer and imide additives with their carbon number distributions for the various substituents of the additives. The percentages by weight of the carbon number ranges for the starting α-olefins were determined by using a Hewlett Packard HP-5890 gas chromatograph with a Chrompack WCOT (wool coated open tubular) Ulti-Metal 10 m×0.53 mm×0.15 μm film thickness column, with an HT SIMDIST CB coating. The sample was introduced via on-column injection onto the column as a solution in toluene. The gas chromatograph was equipped with a hydrogen flame ionization detector. A temperature program was activated to sequentially elute individual isomers. Because two carbons of the α-olefin become part of the polymer chain directly bonded to the repeating maleic anhydride or imide rings, the listed ranges for the "R" substituent shown in Table 1 are two carbons lower than the actual range determined chromatographically. Also, the listed ranges may encompass isomers having the same carbon number.

TABLE 1

| | R Substituent (% By Weight)[3] | | | | | | | | | R' Substituent | | | |
|---|---|---|---|---|---|---|---|---|---|---|---|---|---|
| Additive | $C_{12}$ | $C_{14}$ | $C_{16}$ | $C_{18}$ | $C_{22-26}$ | $C_{28-38}$ | $C_{40-48}$ | $C_{50-58}$ | $C_{60-76}$ | H | $C_{16}$ | $C_{18}$ | n |
| Imide A | — | — | — | — | 12.3 | 58.5 | 15.9 | 10 | 3.3 | — | 26.0[1] | 68.5[1] | 1.13 |
| Maleic Copolymer B | — | — | — | — | 80.5 | 14 | 3.2 | 1.8 | 0.4 | — | — | — | 3.6 |
| Maleic Copolymer C | — | — | — | — | 12.3 | 58.5 | 15.9 | 10 | 3.3 | — | — | — | 3.41 |
| Malejc Copolymer D | — | — | — | — | 46.4 | 36.3 | 9.6 | 5.9 | 1.8 | — | — | — | 3.52 |
| Maleic Copolymer E | 33.1 | 0.2 | — | — | 30.9 | 24.2 | 6.4 | 3.9 | 1.2 | — | — | — | 5.88 |
| Maleic Copolymer F | 99.3 | 0.6 | — | — | — | — | — | — | — | — | — | — | 10.6 |
| Maleic Copolymer G | — | 1.3 | 98.4 | 0.3 | — | — | — | — | — | — | — | — | 4.1 |
| Imide H | 99.3 | 0.6 | — | — | — | — | — | — | — | 100 | — | — | [2] |
| Imide I | — | — | — | — | 80.5 | 14 | 3.2 | 1.8 | 0.4 | 100 | — | — | [2] |
| Imide J | — | — | — | — | 12.3 | 58.5 | 15.9 | 10 | 3.3 | 100 | — | — | [2] |

[1]Average representative figures, based on Tallow Composition Table.
[2]Vapor pressure osmometry data were not generated for the samples, preventing calculation of "n". It is expected that the actual "n" values will be within the same range as the samples above.
[3]Total weight may not be 100% as a result of the presence of trace amounts of other materials, and rounding for calculation purposes.

Fuels included in the evaluation of the additives are listed below in Table 2, which provides distillation data for the respective fuels according to test method ASTM D 86. The data indicate the boiling point temperature (° C.) at which specific volume percentages of the fuel have been recovered from the original pot contents, at atmospheric pressure.

TABLE 2

| | | Percentage Distilled/Temperature (° C.) | | | | | | | | | | | | |
|---|---|---|---|---|---|---|---|---|---|---|---|---|---|---|
| Fuel | Initial B.P. | 5% | 10% | 20% | 30% | 40% | 50% | 60% | 70% | 80% | 90% | 95% | Final B.P. | % Residue |
| 1 | 178 | 204 | 213 | 226 | 237 | 249 | 259 | 270 | 283 | 297 | 314 | 327 | 352 | 0.6 |
| 2 | 183 | 217 | 231 | 249 | 262 | 272 | 282 | 292 | 303 | 314 | 336 | 354 | 357 | 0.1 |
| 3 | 173 | 198 | 211 | 228 | 241 | 253 | 263 | 273 | 284 | 297 | 313 | 325 | 352 | 0.2 |
| 4 | 183 | 206 | 220 | 235 | 247 | 257 | 267 | 277 | 283 | 305 | 326 | 346 | 350 | 0.9 |
| 5 | 186 | 201 | 208 | 226 | 238 | 252 | 263 | 276 | 290 | 307 | 333 | 351 | 364 | 1.0 |
| 6 | 171 | 191 | 204 | 218 | 237 | 249 | 261 | 272 | 283 | 296 | 307 | 324 | 351 | 0.8 |
| 7 | 195 | 210 | 219 | 231 | 241 | 252 | 263 | 276 | 283 | 306 | 332 | 352 | 364 | 1.1 |

To evaluate whether the diesel fuels listed in Table 2 would be considered hard to treat, the temperature difference between the 20% distilled and 90% distilled temperatures (90%–20%), and 90% distilled temperature and final boiling point (90%-FBP) were calculated. Also, the final boiling point was included. The data are provided in Table 3. A 90%–20% temperature difference of about 100°–120° C. for a middle distillate cut fuel is considered normal; a difference of about 70°–100° C. is considered narrow and hard to treat; and a difference of less than about 70° C. is considered extreme narrow and hard to treat. A 90%-FBP temperature difference in the range of about 25° C. to about 35° C. is considered normal; a difference of less than about 25° C. is considered narrow and hard to treat; and a difference of more than about 35° C. is considered hard to treat. A final boiling point below about 360° C. or above about 380° C. is considered hard to treat. Distillation data were generated by utilizing the ASTM D 86 test method.

TABLE 3

| | Temperature Difference (° C.) | | |
|---|---|---|---|
| Fuel | 90%–20% | 90%-FBP | FBP(° C.) |
| 1 | 88 | 38 | 352 |
| 2 | 87 | 21 | 357 |
| 3 | 85 | 39 | 352 |
| 4 | 91 | 24 | 350 |
| 5 | 107 | 31 | 364 |
| 6 | 89 | 44 | 351 |
| 7 | 101 | 31 | 363 |

If the fuel met at least one of the above three evaluation parameters, i. e., 90 %–20% distilled temperature difference, 90%-final boiling point distilled temperature difference, or final boiling point, it was considered hard to treat. Based on the evaluation parameters and the data in Tables 2 and 3, fuels 1, 2, 3, 4 and 6 are considered hard to treat, and fuels 5 and 7 are considered normal. As the following examples demonstrate, the wax anti-settling additives of the invention have beneficial effects when used with both normal and hard-to-treat fuels.

Example 1

Fuel 1 was mixed with varying concentrations of imide "A" having the structure described above. The fuel-additive mixtures were placed in 10.0 ml graduated test tubes cooled to −20° C. and evaluated for wax suspending effectiveness according to the test method described above. The concentration of the R substituent in the range of $C_{22-38}$ was 70.8% by weight. The results are set out in Table 4.

TABLE 4

| | Fuel Composition (Fuel #1; Imide A) | | | |
|---|---|---|---|---|
| Time (days) | No Additive | 100 ppm A | 250 ppm A | 1000 ppm A |
| | % Unsettled Wax | | | |
| 0 | 100 | 100 | 100 | 100 |
| 5 | 46 | 74 | 98 | 100 |
| 10 | 42 | 64 | 85 | 100 |
| 20 | 34 | 55 | 74 | 98 |
| 30 | 25 | 49 | 69 | 97 |

Example 2

Fuel 1 was mixed with varying concentrations of maleic anhydride α-olefin copolymer "B" having the structure described above. The fuel-additive mixtures were placed in 10.0 ml graduated test tubes cooled to −20° C. and evaluated for wax suspending effectiveness according to the above test method. The concentration of the R substituent in the range of $C_{22-38}$ was 94.6% by weight. The results are set out in Table 5.

TABLE 5

| | Fuel Composition (Fuel #1; Copolymer B) | | | |
|---|---|---|---|---|
| Time (days) | No Additive | 100 ppm B | 250 ppm B | 1000 ppm B |
| | % Unsettled Wax | | | |
| 0 | 100 | 100 | 100 | 100 |
| 5 | 46 | 86 | 97 | 98 |
| 10 | 42 | 73 | 92 | 97 |
| 20 | 34 | 66 | 87 | 97 |
| 30 | 25 | 59 | 77 | 96 |

Example 3

Fuel 1 was mixed with varying concentrations of maleic anhydride α-olefin copolymer "C" having the structure described above. The fuel-additive mixtures were placed in 10.0 ml graduated test tubes cooled to −20° C. and evaluated for wax suspending effectiveness according to the above test method. The concentration of the R substituent in the range of $C_{22-38}$ was 70.8% by weight. The results are set out in Table 6.

TABLE 6

| Time (days) | Fuel Composition (Fuel #1; Copolymer C) | | | |
|---|---|---|---|---|
| | No Additive | 100 ppm C | 250 ppm C | 1000 ppm C |
| | % Unsettled Wax | | | |
| 0 | 100 | 100 | 100 | 100 |
| 5 | 46 | 85 | 94 | 99 |
| 10 | 42 | 65 | 85 | 99 |
| 20 | 34 | 56 | 73 | 98 |
| 30 | 25 | 49 | 68 | 98 |

Example 4

Fuel 1 was mixed with varying concentrations of maleic anhydride α-olefin copolymer "D" having the structure described above. The fuel-additive mixtures were placed in 10.0 ml graduated test tubes cooled to −20° C. and evaluated for wax suspending effectiveness according to the above test method. The concentration of the R substituent in the range of $C_{22-38}$ was 82.7% by weight. The results are set out in Table 7.

TABLE 7

| Time (days) | Fuel Composition (Fuel #1; Copolymer D) | | | |
|---|---|---|---|---|
| | No Additive | 100 ppm D | 250 ppm D | 1000 ppm D |
| | % Unsettled Wax | | | |
| 0 | 100 | 100 | 100 | 100 |
| 5 | 46 | 99 | 99 | 99 |
| 10 | 42 | 98 | 99 | 99 |
| 20 | 34 | 96 | 98 | 98 |
| 30 | 25 | 91 | 96 | 98 |

Example 5

Fuel 1 was mixed with varying concentrations of maleic anhydride α-olefin copolymer "E" having the structure described above. The concentration of the R substituent in the range of $C_{22-38}$ was 55. 1% by weight, substantially less than the corresponding $C_{22-38}$ concentrations of imide A, and maleic copolymers B, C and D. The fuel-additive mixtures were placed in 10.0 ml graduated test tubes cooled to −20° C. and evaluated for wax suspending effectiveness according to the above test method. The results are set out in Table 8.

TABLE 8

| Time (days) | Fuel Composition (Fuel #1; Copolymer E) | | | |
|---|---|---|---|---|
| | No Additive | 100 ppm E | 250 ppm E | 1000 ppm E |
| | % Unsettled Wax | | | |
| 0 | 100 | 100 | 100 | 100 |
| 5 | 46 | 99 | 60 | 26 |
| 10 | 42 | 98 | 53 | 23 |
| 20 | 34 | 85 | 46 | 22 |
| 30 | 25 | 55 | 39 | 21 |

As the data in Tables 4 through 8 indicate, Imide A and Maleic Copolymers B, C and D exhibit improved wax anti-settling characteristics at all concentration ranges compared to the untreated fuel, the wax anti-settling effect improving with increasing concentration. Maleic Copolymer E demonstrated wax anti-settling improvement over untreated fuel at low concentration, i.e., up to about 250 ppm additive. At additive concentration levels substantially higher, i.e., at 1,000 ppm, the data indicate that Copolymer E incorporated into the fuel actually promoted wax settling.

Example 6

To evaluate the operability enhancement effect of an added ethylene vinyl acetate nucleator copolymer component (I), with a maleic anhydride α-olefin wax anti-settling copolymer, an ethylene vinyl acetate copolymer (I) was incorporated with Fuel 1 and copolymer "D" in the concentrations set out below in Table 9. This table shows the effect of the wax anti-settling additive on enhancing the wax suspension for fuels treated with nucleator additives. Example 8 will further explain the importance of wax suspension on improving the final operability performance. The fuel-additive mixtures were placed in 10.0 ml graduated test tubes cooled to −20° C. and evaluated for wax suspending effectiveness according to the above test method. The results are set out in Table 9. EVA copolymer I had a Brookfield viscosity at 140° C. of 115 cP, 32% vinyl acetate content by weight, a number average molecular weight of 1,889, a weight average molecular weight of 3,200 and a ratio of weight average to number average molecular weight of 1.69.

TABLE 9

| Time (days) | Fuel Composition (Fuel #1; Copolymer D; EVA Copolymer I) | | | |
|---|---|---|---|---|
| | No Additive | EVA (I) 100 ppm | EVA (I) 250 ppm | EVA (I) 100 ppm + 100 ppm D |
| | % Unsettled Wax | | | |
| 0 | 100 | 100 | 100 | 100 |
| 5 | 46 | 74 | 97 | 99 |
| 10 | 42 | 55 | 92 | 97 |
| 20 | 34 | 30 | 66 | 91 |
| 30 | 25 | 22 | 52 | 86 |

Example 7

Similar to Example 6 and to achieve the same goal, i.e., to enhance the engine operability performance, the ethylene vinyl acetate copolymer component (I) described in Example 6 was combined with imide "A" described in Example 1 with Fuel 1 in the concentrations set out below in Table 10. This table shows the effect of the wax anti-settling additive on enhancing the wax suspension for fuels treated with nucleator additives. Example 8 below further demonstrates the importance of wax suspension on improving the final operability performance. The fuel-additive mixtures were placed in 10.0 ml graduated test tubes cooled to −20° C. and evaluated for wax suspending effectiveness according to the above test method. The results are set out in Table 10.

TABLE 10

| Time (days) | Fuel Composition (Fuel #1, Imide A, EVA Copolymer I) | | | | |
|---|---|---|---|---|---|
| | No Additive | EVA (I) 100 ppm | EVA (I) 250 ppm | EVA (I) 350 ppm | EVA (I) 100 ppm + 100 ppm A |
| | % Unsettled Wax | | | | |
| 0 | 100 | 100 | 100 | 100 | 100 |
| 5 | 46 | 74 | 97 | 97 | 100 |
| 10 | 42 | 55 | 92 | 93 | 97 |

TABLE 10-continued

| Time (days) | Fuel Composition (Fuel #1, Imide A, EVA Copolymer I) | | | | |
|---|---|---|---|---|---|
| | No Additive | EVA (I) 100 ppm | EVA (I) 250 ppm | EVA (I) 350 ppm | EVA (I) 100 ppm + 100 ppm A |
| | % Unsettled Wax | | | | |
| 20 | 34 | 30 | 66 | 70 | 92 |
| 30 | 25 | 22 | 52 | 59 | 87 |

Example 8

Fuels 1 and 2 were separately mixed with a combination of additives to demonstrate the enhancement of the operability performance due to the wax anti-settling additive in the presence of cold flow improvers (CFI). EVA copolymer I and EVA-isobutylene terpolymer I were separately introduced into Fuels 1 and 2 with no other additive, and also combined with wax anti-settling additives Copolymer D and Imide A to evaluate the effect of the wax anti-settling additive on CFI performance. EVA terpolymer I had a Brookfield viscosity at 140° C. of 125 cP, 37% vinyl acetate content by weight, a number average molecular weight of 2,237, a weight average molecular weight of 11,664 and a ratio of weight average to number average molecular weight of 5.2. CFI was evaluated utilizing the specifically-designed test set out below, which combines features of a cold flow test with those of a wax anti-settling test.

The equipment used for the test was the same as that employed for the CFPP test (IP 309). The whole equipment assembly with the test fuel composition was placed in a cooling bath and conditioned at −20° C. for 200 minutes. The sample of fuel with additives was then pulled through the 45 micron screen under 200 mm water vacuum. The time needed to fill the pipette bulb to the mark was recorded. If the bulb could not be filled in 60 seconds, the run was recorded as a failure.

The results are set out in Table 11. It can be seen that the presence of the wax anti-settling additive improved the test performance relative to the cold flow improver alone.

EVA copolymer I is the same as that described in Example 6.

TABLE 11

Effect of Wax Anti-settling Additives on Diesel Operability Performance

| Fuel | Cold Flow Improver (CFI) | Un-treated Fuel | 250 ppm CFI | 200 ppm CFI + 50 ppm Copolymer-D | 200 ppm CFI + 50 ppm Imide-A |
|---|---|---|---|---|---|
| | | Time in Seconds | | | |
| Fuel 1 | Copolymer-I | Failed | 34 | 11 | 12 |
| Fuel 1 | Terpolymer-I | Failed | 29 | 9 | 11 |
| Fuel 2 | Terpolymer-I | Failed | 35 | 21 | 22 |

Example 9

To demonstrate the relatively narrow effective chain length range for additives having beneficial wax anti-settling properties, maleic anhydride α-olefin copolymer additives F & G were tested for wax anti-settling activity over a 30 day period utilizing Fuel 1 at varying concentrations of additive. The fuel-additive mixtures were placed in 10.0 ml graduated test tubes cooled to −20° C. and evaluated for wax suspending effectiveness according to the above wax anti-settling test method. Additives F and G are described above in Table 1. The % unsettled wax values at various additive concentrations are set out in Table 12, and compared with data previously generated for Additive D.

TABLE 12

30 Day Test @ −20° C.

| Additive | Concentration In Fuel 1 (by wt) | % Unsettled Wax |
|---|---|---|
| None | | 25 |
| F | 100 ppm | 22 |
| F | 250 ppm | 24 |
| F | 1000 ppm | 35 |
| G | 100 ppm | 19 |
| G | 250 ppm | 7 |
| G | 1000 ppm | 2 |
| D (from Example 4) | 100 ppm | 93 |
| D | 250 ppm | 97 |
| D | 1000 ppm | 98 |

Results indicate that copolymers F and G are less efficient in imparting wax anti-settling properties to the fuel.

Example 10

To demonstrate the relatively narrow effective chain length range for additives having beneficial wax anti-settling properties, imide additives H, I and J were compared with imide additive A by testing for wax anti-settling activity over a 15 day period utilizing Fuel 1 at varying concentrations of additive. The fuel-additive mixtures were placed in 10.0 ml graduated test tubes cooled to −20° C. and evaluated for wax suspending effectiveness according to the above wax anti-settling test method. Additives H, I and J are described above in Table 1. The results are set out in Table 13.

TABLE 13

15 Day Test @ −20° C.

| Additive | Concentration in Fuel 1 (by wt) | % Unsettled Wax |
|---|---|---|
| None | | 39 |
| A | 100 ppm | 62 |
| A | 250 ppm | 73 |
| H | 100 ppm | 14 |
| H | 250 ppm | 13 |
| I | 100 ppm | 17 |
| I | 250 ppm | 34 |
| J | 100 ppm | 17 |
| J | 250 ppm | 22 |

Example 11

Flow improver additives were incorporated into Fuel 1 with and without Imide A and evaluated for wax anti-settling properties. The flow improver additives were designated EVA terpolymer II and EVA terpolymer III. The additives were incorporated in the concentrations set out below in Tables 14 and 15. The fuel-additive mixtures were placed in 10.0 ml graduated test tubes cooled to −20° C. and evaluated for wax suspending effectiveness according to the above test method. The results are set out in Tables 14 and 15. EVA terpolymer II had a Brookfield viscosity at 140° C. of 190 cP, 42% vinyl acetate content by weight, a number average molecular weight of 1,902, a weight average molecular weight of 3,326, and a ratio of weight average to number average molecular weight of 1.7. EVA terpolymer III had a Brookfield viscosity at 140° C. of 135 cP, 45% vinyl acetate content by weight, a number average molecular weight of 2,067, a weight average molecular weight of 6,438, and a ratio of weight average to number average molecular weight of 3.1.

TABLE 14

| Fuel Composition (Fuel #1; Imide A; EVA Terpolymers II and III) | | | | | |
|---|---|---|---|---|---|
| Time (Days) | Fuel 1 | EVA Terpolymer II 750 ppm | EVA Terpolymer II 750 ppm + 100 ppm A | EVA Terpolymer III 750 ppm | EVA Terpolymer III 750 ppm + 100 ppm A |
| | | % Unsettled Wax @ −20° C. | | | |
| 1 | 66 | 75 | 100 | 93 | 100 |
| 5 | 46 | 50 | 100 | 54 | 100 |
| 7 | 43 | 44 | 100 | 48 | 99 |
| 10 | 42 | 38 | 99 | 42 | 99 |
| 13 | 39 | 36 | 99 | 34 | 99 |

TABLE 15

| 4/29 Fuel Composition (Fuel #1; Imide A; EVA Terpolymer III) | | | | |
|---|---|---|---|---|
| Time (Days) | Fuel 1 | EVA Terpolymer III 250 ppm | EVA Terpolymer III 500 ppm | EVA Terpolymer III 250 ppm + 250 ppm A |
| | | % Unsettled Wax @ −20° C. | | |
| 1 | 66 | 8 | 95 | 100 |
| 5 | 46 | 8 | 60 | 99 |
| 7 | 43 | 8 | 54 | 97 |
| 10 | 42 | 7 | 41 | 96 |
| 13 | 39 | 6 | 35 | 95 |

In Table 14 EVA terpolymers II and III were incorporated into the fuel at higher concentration levels of 750 ppm. Without any Imide A, the fuel with terpolymers II and III exhibited wax anti-settling properties roughly equivalent to the fuel without additive. Incorporation of Imide A with terpolymers II and III significantly improved the wax anti-settling properties of the fuel. In Table 15 incorporation of 250 ppm terpolymer III significantly decreased the wax anti-settling properties of Fuel 1. The addition of 500 ppm of terpolymer III improved the wax anti-settling properties of the fuel relative to 250 ppm terpolymer III, but this improvement was in turn significantly less substantial than that demonstrated in Fuel 1 by the introduction of 250 ppm terpolymer III and 250 ppm Imide A. As the data in Tables 14 and 15 demonstrate, incorporation of the EVA terpolymer alone into Fuel 1 had either substantially no effect or an adverse effect on the wax anti-settling properties of the fuel.

Example 12

To evaluate the effect of a wax anti-settling additive of the invention on other fuels, Copolymer D was combined individually with fuels 3, 4, 5, 6 and 7 and evaluated using the wax anti-settling test described above. The fuel-additive mixtures for fuels 3, 4, 5 and 6 were placed in 10.0 ml graduated test tubes cooled to −20° C. and evaluated for wax suspending effectiveness according to the above wax anti-settling test method. The test results utilizing Copolymer D are set out below in Table 16. The fuel-additive mixture for fuel 7 and Copolymer D was prepared and tested identically, except that the test tube was cooled to −13° C. The results for this run are set out separately in Table 17.

TABLE 16

| % Unsettled Wax @ −20° C.; Fuels #3–6 | | | | | | | | |
|---|---|---|---|---|---|---|---|---|
| | Fuel #3 | | Fuel #4 | | Fuel #5 | | Fuel #6 | |
| Time (days) | No Additive | 100 ppm | No Additive | 100 ppm | No Additive | 100 ppm | No Additive | 100 ppm |
| 0 | 100 | 100 | 100 | 100 | 100 | 100 | 100 | 100 |
| 5 | 74 | 97 | 84 | 100 | 86 | 100 | 74 | 98 |
| 10 | 57 | 95 | 79 | 97 | 80 | 98 | 59 | 94 |
| 20 | 40 | 93 | 65 | 95 | 67 | 96 | 45 | 93 |
| 30 | 23 | 90 | 49 | 91 | 50 | 93 | 25 | 91 |

TABLE 17

| % Unsettled Wax @ −13° C.; Fuel #7 | | | |
|---|---|---|---|
| Time (days) | No Additive | 250 ppm | 1000 ppm |
| 0 | 100 | 100 | 100 |
| 5 | 77 | 94 | 94 |
| 10 | 66 | 92 | 93 |
| 20 | 58 | 87 | 90 |
| 30 | 32 | 82 | 85 |

The additives of this invention improve the wax anti-settling characteristics of both normal and hard-to-treat fuels. These additives may be used in combination with other fuel additives, such as those for improving flow properties to enhance the operability of the fuel by encompassing the wax anti-settling improvement as well as the properties improved by incorporation of the other additives.

Thus it is apparent that there has been provided, in accordance with the invention, a wax anti-settling additive and fuel composition which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, departures may be made from such details without departing from the spirit or scope of the general inventive concept.

What is claimed is:

1. A distillate fuel composition having improved wax anti-settling properties comprising a major proportion of a distillate fuel and an improved wax anti-settling property effective amount of a imide having the formula

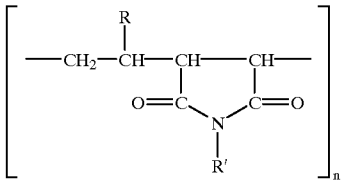

wherein R has at least 60% by weight of a hydrocarbon substituent from about 20 to about 40 carbon atoms, R' has at least 80% by weight of a hydrocarbon substituent from 16 to 18 carbon atoms, and n is from about 1 to about 8.

2. The composition of claim 1 wherein said distillate fuel is a middle distillate fuel.

3. The composition of claim 1 wherein said distillate fuel is No. 2 diesel fuel.

4. The composition of claim 1 wherein said distillate fuel is hard-to-treat fuel.

5. The composition of claim 1 further wherein said imide is derived from substantially equimolar proportions of maleic anhydride and α-olefin.

6. The composition of claim 1 wherein R has about 12% by weight of a hydrocarbon substituent from 22 to 26 carbons and about 58% by weight of a hydrocarbon substituent from 28 to 38 carbons, and R' has at least about 60% of a hydrocarbon substituent having 18 carbon atoms.

7. The composition of claim 1 further wherein the effective wax anti-settling amount of said imide is about 25 to about 1,000 ppm by weight of said distillate fuel.

8. The composition of claim 1 further wherein the effective wax anti-settling amount of said imide is about 50 to about 250 ppm by weight of said distillate fuel.

* * * * *